US005566474A

United States Patent [19]

Leick et al.

[11] Patent Number: 5,566,474

[45] Date of Patent: Oct. 22, 1996

[54] SPORT BOOT HAVING A FIXED-LACE CLOSURE SYSTEM

[75] Inventors: Patrick Leick, Villaz; Thierry Donnadieu, Poisy, both of France

[73] Assignee: Salomon S.A., Metz-Tessy, France

[21] Appl. No.: 261,046

[22] Filed: Jun. 14, 1994

[30] Foreign Application Priority Data

Jun. 21, 1993 [FR] France ..... 93 07716

[51] Int. Cl.[6] ..... A43C 11/00; A43C 1/00; A43C 3/00; A43B 5/04

[52] U.S. Cl. ..... 36/50.1; 36/50.5; 24/713.4; 24/713.9

[58] Field of Search ..... 36/117–121, 50.1, 36/50.5; 24/712.5, 713.4, 713.9, 714.4, 714.5

[56] References Cited

U.S. PATENT DOCUMENTS

| | | | |
|---|---|---|---|
| 254,343 | 2/1882 | Lequin | 24/713.9 |
| 262,653 | 8/1882 | Ducker . | |
| 273,707 | 3/1883 | Bray | 24/714.5 |
| 526,830 | 10/1894 | Duljé | 24/712.5 |
| 846,702 | 3/1907 | Spies | 24/713.4 |
| 2,017,679 | 10/1935 | Allis | 24/713.4 |
| 2,454,335 | 11/1948 | Nichols | 24/713.4 |

FOREIGN PATENT DOCUMENTS

| | | | |
|---|---|---|---|
| 342923 | 9/1904 | France | 24/713.9 |
| 175507 | 10/1906 | Germany | 24/713.9 |
| 1211513 | 2/1966 | Germany . | |
| 1169109 | 5/1987 | Italy . | |
| 37873 | 10/1906 | Switzerland . | |
| 411623 | 11/1966 | Switzerland . | |

*Primary Examiner*—B. Dayoan
*Attorney, Agent, or Firm*—Greenblum & Bernstein P.L.C.

[57] ABSTRACT

A sport boot including an upper equipped with an opening to enable passage of the foot, and further including an internal quarter and an external quarter connected with respect to one another by a lace or cable in connection with a blocking device or blocker, along a determined alternate path around return elements arranged on either side of the opening. The ends of the strands forming the lace are rendered integral with two fixed anchoring points obtained in a lower end zone of the lacing located towards the front of the boot, the strands mutually forming a free loop at their opposite end, adapted to constitute a single gripping element to exert a traction along a force distributed symmetrically along each of the strands from both fixed points.

15 Claims, 2 Drawing Sheets

SPORT BOOT HAVING A FIXED-LACE CLOSURE SYSTEM

BACKGROUND OF THE INVENTION

1. Field of the Invention

The present invention is related to a sport boot including an external sole on which an upper equipped with an opening to enable passage of the foot is mounted. The boot includes an internal quarter and an external quarter connected to one another by a closure system constituted by a lace or cable forming two strands, in connection with a blocking device or blocker and mutually connecting a series of return elements along a determined alternate path, fixedly arranged on the quarters on either side of the opening in the vicinity of their respective edges located across from each other and defining a lacing zone, so that during a traction on the strands of the lace or cable, the latter tightens along the quarters by means of return elements to bring the quarters close together and to maintain them in tightening position on the foot by means of the blocker.

2. Discussion of Background and Material Information

A similar boot is known from U.S. Pat. No. 262,653 which discloses a lacing device using only one lace, whose single strand is alternately passed behind the return elements located on either side and in an offset manner on each quarter of the boot. According to this device, the single strand of the lace is hooked by one of its ends in a lower end zone of the lacing located towards the front of the boot, whereas, at its other end directed towards the upper portion of the boot, it comprises a hooking device for the free end of said strand after tightening.

Such a lacing device clearly shows that the tightening produced by a single strand has the major disadvantage of providing a poor distribution of the tension exerted on the lace.

According to another document constituted by Italian Patent No. 19700/83, a lacing device constituted by a lace forming two strands is also known, whose ends, located in the lower lacing zone, mutually form a non-discontinuous loop adapted to freely slide into the last return elements located in this zone, in accordance with the traction exerted on each strand during tightening. The blocking of the lace after tightening is obtained by a blocker arranged at the other end of the strands.

According to a first embodiment of this device, the tightening of the lace is obtained by a traction on the end of the free strands, after which, the blocker, inserted between said strands, is slidably brought into blocking position.

In this way, since traction inequalities are inevitably produced on each strand during tightening of the boot, it results in a progressive dislocation of the placement of the blocker with respect to the median lacing line, this dislocation can go as far as to release one of the strands. In addition to the poor tightening and tension distribution thus caused, another disadvantage resides at the manufacturing level. Indeed, during assembly, it is difficult to precisely center the blocker placement.

According to a second embodiment, partially overcoming the disadvantages of the first, the free ends of the lace strands are joined with respect to one another in the form of a loop, and the blocker is arranged between the strands, but in the lacing zone, i.e., between two pairs of successive return elements. Such an arrangement not only hampers the action on the blocker when the lacing zone is finally covered, which further leads to the implementation of a supplementary activating cable of said blocker, rendering a blind activation of the latter from an external zone of the boot, but in addition, as soon as the cable can freely slide in the end lacing zone, the disadvantage mentioned above in the first embodiment remains, namely, a poor tightening and distribution of the tension on each strand.

SUMMARY OF THE INVENTION

The goal of the present invention is to overcome all of these disadvantages mentioned above.

To this end, it relates to a sport boot comprising an external sole on which an upper equipped with an opening to enable passage of the foot is mounted, and comprising an internal quarter and an external quarter connected with respect to one another by a closure system constituted by a lace or cable forming two strands, in connection with a blocking device or blocker and mutually connecting a series of return elements along a determined alternate path, fixedly arranged on said quarters on either side of said opening in the vicinity of its respective edges located across from one another and defining a lacing zone, so that during a traction on the strands of the lace or cable, the latter tightens along the quarters by means of the return elements to bring said quarters close together and to maintain them in tightening position on the foot by means of the blocker, wherein the ends of the strands forming the lace are rendered integral with two fixed anchoring points obtained in a lower end zone of the lacing located towards the front of the boot, said strands mutually forming at their opposite end a free loop adapted to constitute a single gripping element for exerting a traction along a force distributed symmetrically along each of the strands from both fixed anchoring points. Indeed, such an arrangement enables quick and balanced tightening of the quarters according to a selected force and is capable of being undertaken by a single hand of the user, the latter using the other hand on the blocker which is slidably mounted on the strands in the zone where they form the free loop in order to block these strands in the desired tightening position.

In this way, since the lace is always pulled from the fixed anchoring points from a common final loop, it neither produces asymmetry between the strands of the lace during traction, nor a dislocation of the position of the blocker with respect to the strands.

BRIEF DESCRIPTION OF THE DRAWINGS

The invention will be better understood, and other characteristics thereof will be shown by means of the following description with reference to the annexed drawings, illustrating as a non-limiting example, how the invention can be obtained and wherein.

DETAILED DESCRIPTION OF THE PREFERRED EMBODIMENTS

Figure 1:
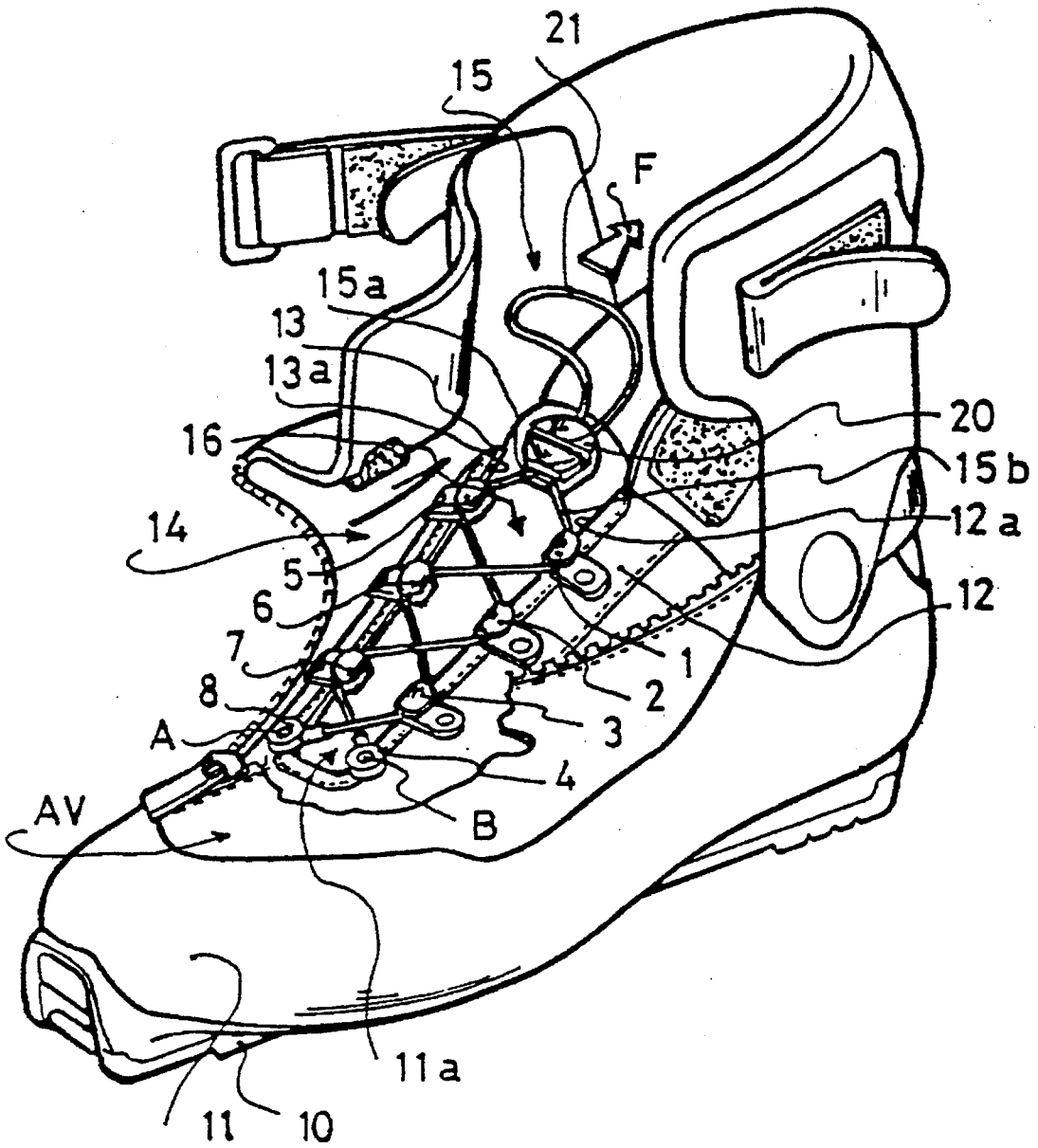
FIG. 1 represents a perspective view of a boot, comprising a lacing closure device, as per the invention.

The sport boot shown in FIG. 1 comprises an external sole 10 on which an upper 11 equipped with a frontward opening 11*a* to enable passage of the foot is mounted, and comprising an internal quarter or side 12 and an external quarter or side 13 connected with respect to one another by a closure system 14. This closure system 14 is constituted by a lace or cable 15 forming two strands 15*a* and 15*b*, in connection with a blocking device or blocker 20, and mutually connecting a series of return elements 1 to 8 along a determined path, fixedly arranged on either side of opening 11*a* on said quarters 12, 13, in the vicinity of their respective edges 12*a*, 13*a* located across from each other. These edges mutually define a lacing zone 16, so that during an action on strands 15*a* and 15*b* of lace 15, the latter tightens along quarters 12, 13, by means of return elements 1 to 8. Thus, said quarters 12, 13 are brought close together and maintained in tightening position on the foot by means of blocker 20.

As per the invention, whose general principle is shown in FIG. 1, the "free" ends of strands 15*a*, 15*b* forming lace 15, are rendered integral to two fixed anchoring points A and B. In this case, these anchoring points A and B are constituted by return elements 8 and 4 adapted to constitute hooks or to enable anchoring of lace 15, according to its intended purpose. This characteristic will be described in detail later.

The anchoring points A and B are therefore obtained by arranging elements 8 and 4 in a lower end zone of the lacing located towards the front (AV) of the boot. The fixing of the free ends of strands 15*a* and 15*b* on elements 8 and 4 constituting anchoring points A, B, obtained by any means such as, for example, a knot, splice, attached abutment, etc. . . .

Thus fixed by their ends, strands 15*a*, 15*b* are led in a crossed zigzag towards the upper portion of the boot, by respectively twisting around return elements 3, 6, 1, and 7, 2, 5 to then mutually form a free loop 21.

This loop 21 advantageously constitutes a single traction element to exert a tightening traction along a force F, distributed symmetrically along each of strands 15*a*, 15*b*, from both fixed points A,B for a balanced tightening of quarters 12, 13. In this manner, the force F can be exerted by a single hand of the user, and when said force is attained, the latter, with the other hand, acts to control blocker 20 which is slidably mounted on strands 15*a*, 15*b* in the upper end zone where they form free loop 21 so as to fix the tightening force.

As per another characteristic of the invention, anchoring points A, B, C, D, E, F (see FIGS. 1, 2, 3, 4) intended for fixing the ends of strands 15*a*, 15*b* forming lace 15, as well as each return element 1 to 8 thereof, are arranged symmetrically across from one another on either side of opening 11*a* on quarters 12, 13 along axes XX', YY', ZZ', WW', which are mutually parallel and perpendicular to the longitudinal axis VV' of the boot so as to have an optimum and balanced tightening along the entire length of the upper portion of the foot from its front end zone, so as to promote the practice of sports and especially parallel-stride cross country skiing or normal walking. It should be noted that the symmetrical distribution of the traction force F on each of the strands is only obtained by virtue of anchoring the free ends thereof, guaranteeing exertion of a traction force with respect to these fixed points, and non-sliding, as was the case in the known prior art technique.

In this case, and as illustrated in FIG. 1, anchoring points A,B of the ends of strands 15*a*, 15*b* of lace 15 are arranged across from one another at the end of the lacing zone, the successive return elements 1 to 8 ensuring a pathway of the strands of lace 15 for a symmetrical zigzag lacing.

In spite of the good overall results obtained according to the embodiment of FIG. 1, it was nonetheless revealed during the various tests that the tightening between end elements 4 and 8 could be improved in accordance with the desired effect by means of other embodiments, still based on the same principle.

Figure 2:
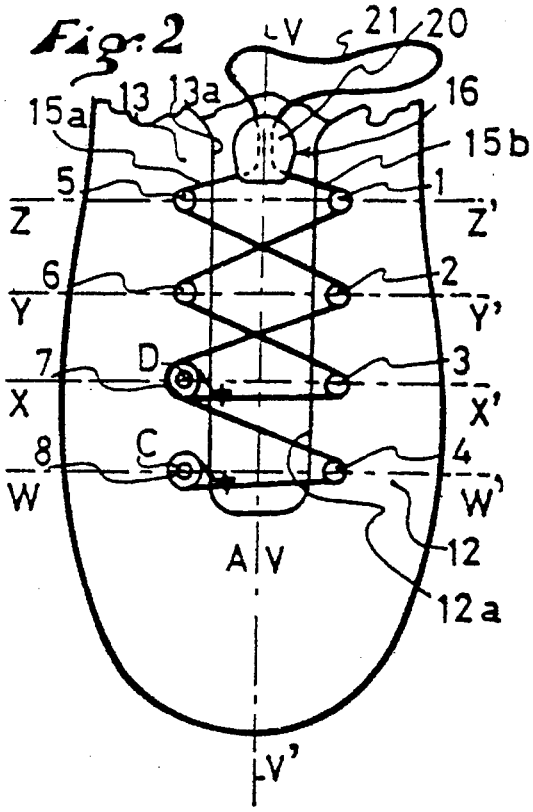
FIGS. 2 and 3 are embodiment variations of a lacing device especially adapted for parallel-stride cross country skiing or walking.

For example, in the embodiment illustrated in FIG. 2, anchoring points C,D of the ends of strands 15*a*, 15*b* of lace 15 are successively arranged at the end of the lacing zone along a same quarter 13, the next to last anchoring point, D, ensuring the fixing of strand 15*a* and simultaneously constituting a return element 7 at a strand 15*b* originating from the other anchoring point C.

It is clearly understood that in this case, the traction on the cable is produced in a transverse direction corresponding to the desired transverse coming together of the quarters of the boot. Such an embodiment therefore enables an optimized tightening with respect to the embodiment of FIG. 1 in which quarters 12, 13 are subjected to a solely diagonally directed traction force at the level of anchoring points A, B.

Figure 3:
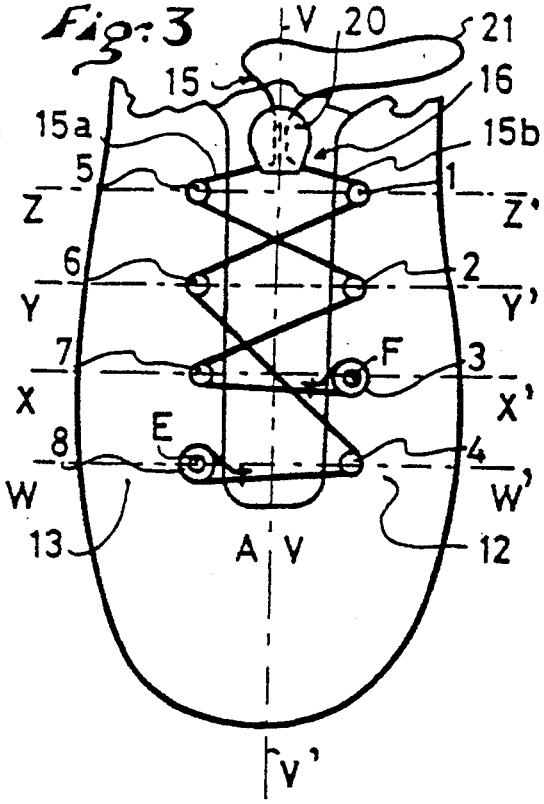

According to an embodiment variation shown in FIG. 3, obtained according to the same objective, the lacing device basically differs from the preceding one shown in FIG. 2 in that anchoring points E, F, of the ends of strands 15*a*, 15*b* of lace 15 are arranged at the end of the lacing zone along one of quarters 13 for E, and for F, directly in front of a return element 4 arranged at the end of the lacing zone on the other quarter 12.

In other words, anchoring points E and F are always arranged successively, but on different quarters and therefore diagonal with respect to one another. In this case, the traction on the cable is indeed always produced transversely as shown in said FIG. 3, and the same effect is obtained as in FIG. 2.

According to this embodiment, none of the anchoring points E and F simultaneously constitute a return element.

As revealed in the embodiment described hereinabove, the number of anchoring points A, B, C, D, E, and F is equal to 8, whether they merge with return elements 1 to 8 or not or whether or not they ensure the simultaneous function of anchoring point and return elements, and these elements are symmetrically distributed on either side of longitudinal axis VV' of the boot, along each of quarters 12, 13.

According to the embodiment of FIG. 3, one can also see that the number of returns is identical along both strands 15*a*, 15*b* of cable or lace 15, from a distinct anchoring point E or F which offers the advantage of providing an identical effect on both strands.

Whatever the case, these embodiments of FIGS. 2 and 3 enable, especially for traditional cross country skiing, a tightening along an optimum length, along the entire upper portion of the foot, but no further, so as to not impede proper positioning of the foot while adjusting the anchoring and tightening up to the end of the zone of the upper portion of the foot.

In skating-stride cross country skiing or other similar techniques (in-line skating. . . ), the problem presents itself differently in the sense that it is then necessary to have a lacing which goes as far towards the front of the foot as possible, in fact, up to the level of the metatarsals, in order to efficiently maintain the foot in this zone during the thrust or propulsion phase, without having tightening problems at the level of the small toe.

In such a situation, it is not possible to make such a lacing length compatible with the morphology of the foot. Indeed, if one wants a tightening up to the level of the big toe in question, it is not possible to have a symmetrical tightening along the other toes, which would cause discomfort.

Figure 4:
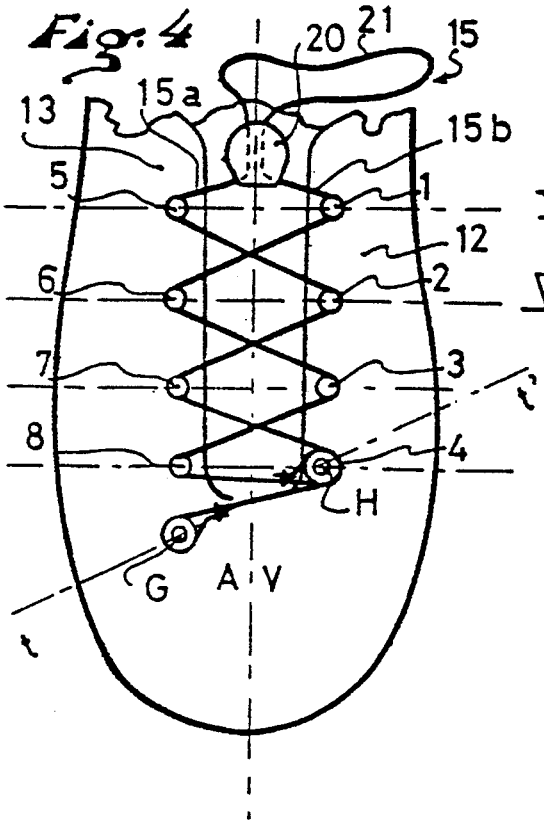
FIG. 4 is an embodiment variation of a lacing device especially adapted for skating-stride cross country skiing.

In order to overcome this problem, and as illustrated in FIG. 4, the anchoring points G,H intended to anchor the ends of strands 15*a*, 15*b* forming lace 15, are arranged on an inclined axis tt', corresponding substantially to that of the metatarsals of the user's foot, so as to ensure an optimum and balanced tightening at the level of all metatarsals including the big toe during a lateral force, especially in the propulsion phase during skating-stride cross country skiing.

In this case, the furthest anchoring point G towards the front (AV) of the boot corresponds to the metatarsal joint zone of the big toe, and ensures fixing of the end of a first strand 15*b* of lace 15, whereas the other anchoring point H of the end of a second strand 15*a* corresponds to the metatarsal joint zone of the small toe and simultaneously ensures the return function 4 of said first strand 15*b*, so as to obtain a number of identical return elements 1, 2, 3, 4 and 5, 6, 7, 8 on each of quarters 12,13 to be tightened, and this according to always convergent forces.

To this end, the boot comprises four return elements 5, 6, 7, 8 and an anchoring point G on internal quarter 13, whereas external quarter 12 comprises four return elements 1, 2, 3, 4, of which end 4 also constitutes an anchoring point H.

This embodiment therefore enables a tightening to be obtained going as far as is possible along the inner side (or median) of the foot and especially beyond the tightening zone of the upper portion of the foot, while retaining the comfort aspect along the external side of the foot.

Figure 5:
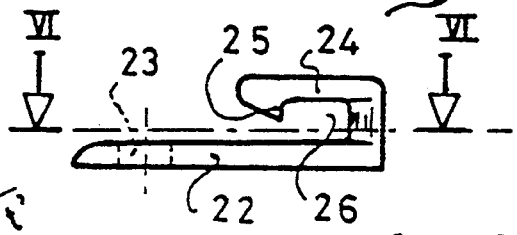
FIG. 5 is an enlarged scale, lateral view of a return element.
Figure 6:
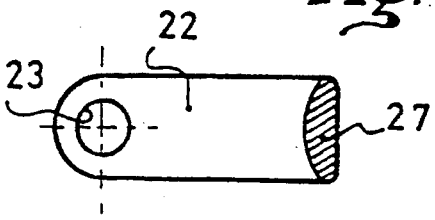
FIG. 6 is a sectional view of a return element along line VI—VI of FIG. 5.

According to another characteristic of the invention shown in FIGS. 5 and 6, each of return elements 1 to 8 is constituted by a flat base 22, comprising a fixing hole 23 extending into one of its ends on the boot, and a hook 24, obtained as such, at its other end, with base 22, along a parallel plane in order to demarcate a housing 26 adapted to laterally receive the lace or cable 15 with an internal projection 25 provided on the free end of hook 24, and to retain it there after the elastic deformation of hook 24 for passage of the cable.

Preferably, the dimensions of housing 26 are provided so as to further prevent the sliding of the end of a strand 15*a* or 15*b* of lace 15 in the longitudinal direction, if that end is equipped with an abutment forming element, so that the return element can also constitute an anchoring point of said end of strand 15*a* or 15*b*. The anchoring of each end of strand 15*a*, 15*b* can also be obtained by simple passage of a loop obtained at that end on hook 24.

According to an improvement, the bottom or projecting portion 27 of return element 1 to 8, constituted by the attachment zone of hook 24 with base 22, is of a section whose inwardly turned portion is rounded to act as a pulley for passage of cable 15.

Advantageously, cable or lace 15 is constituted by a an inextensible material and has a low friction coefficient adapted to promote its sliding in return elements 1 to 8.

Finally, although the invention has been described with reference of particular means, materials and embodiments, it is to be understood that the invention is not limited to the particulars disclosed and extends to all equivalents within the scope of the claims.

What is claimed:

1. A boot comprising:

an external sole;

an upper affixed onto said external sole and having an opening for facilitating insertion of a foot into the boot, said upper comprising a first portion and a second portion, said opening extending between said first and second portions;

a closure system for connecting said first and second portions of said upper, said closure system comprising a series of return elements, a respective plurality of said return elements being affixed to each of said first portion and said second portion of said upper;

a blocking device; and a lace or cable forming two strands, said lace or cable extending in a predetermined path between ones of said return elements and defining a lacing zone, said lacing zone comprising a front lower end and a rear upper end, each of said two strands of said lace or cable having a respective end, each respective end of said two strands being anchored at a respective anchoring location by respective anchoring means at said front lower end of said lacing zone, said two strands extending rearwardly from said lower end of said lacing zone, along said predetermined path between ones of said return elements and, rearward of said ones of said return elements, extending through said blocking device and, beyond said blocking device, said two strands of said lace or cable forming a free loop;

said free loop constituting a single means for gripping said lace or cable and for exerting a traction force distributed symmetrically along said two strands from said respective anchoring locations at said front lower end of said lacing zone to bring said first and second portions toward one another for tightening said first and second portions on the foot; and said blocking device comprising a means for blocking said lace or cable upon attaining a predetermined tightening position of said first and second portions during exertion of said traction force.

2. A boot according to claim 1, wherein:

said anchoring locations (G,H) for said ends of said two strands of said lace or cable are positioned along an axis substantially corresponding to an axis extending along the metatarsals of the foot.

3. A boot according to claim 2, wherein:

one of said anchoring locations (G) is a more forwardly positioned anchoring location and the other of said anchoring locations (H) is a less forwardly positioned anchoring location;

said more forwardly positioned anchoring location (G) corresponds in location to the metatarsal joint zone of the big toe of the foot; and said less forwardly positioned anchoring location (H) corresponds in location to the metatarsal joint zone of the small toe of the foot and simultaneously one of said return elements is positioned at said less forwardly positioned anchoring location, said plurality of return elements on said first portion of said upper being identical in number to said plurality of return elements on said second portion of said upper.

4. A boot according to claim 3, wherein:

said first portion of said upper comprises an inside portion, corresponding to an inside portion of the foot, and said second portion of said upper comprises an outside portion, corresponding to an outside portion of the foot; and said outside portion having four return elements affixed thereto, a forwardmost one of said four return elements of said outside portion also constituting one of said anchoring means (H), said inside portion having four return elements affixed thereto and the other of said anchoring means (G) being affixed thereto forwardly of said return elements.

5. A boot according to claim 1, wherein:

the boot has a longitudinal median plane; and said anchoring locations (A,B; C,D; E,F) for said ends of said two strands of said lace or cable and said return elements are symmetrically arranged across from each other on said first and second portions of said upper to define a plurality of mutually parallel lines, said parallel lines being perpendicular to said longitudinal median plane of the boot.

6. A boot according to claim 5, wherein:

said anchoring locations (A,B) for said ends of said two strands of said lace or cable are arranged across from each other at said front lower end of said lacing zone, said return elements ensuring said predetermined path of said lace or cable being a symmetrical zig-zag.

7. A boot according to claim 5, wherein:

one of said anchoring locations (E) for said ends of said two strands of said lace or cable is arranged at said front lower end of said lacing zone on said first portion of said upper;

one of said return elements on said second portion of said upper is arranged at said front lower end of said lacing zone; and the other of said anchoring locations (F) for said ends of said two strands of said lace or cable is arranged on said second portion of said upper, directly rearwardly of said one of said return elements.

8. A boot according to claim 5, wherein:

both of said anchoring locations (C,D) for said ends of said two strands of said lace or cable are arranged successively on one of said first and second portions; and one of said anchoring locations (C) comprises one said anchoring means for anchoring one of said ends of said two strands and the other of said anchoring locations (D) simultaneously comprises:

the other of said anchoring means for the other of said ends of said two strands; and one of said return elements for said one of said two strands.

9. A boot according to claim 5, wherein:

the combined total of anchoring locations (A,B; C,D; E,F) and return elements is eight; and said anchoring locations (A,B; C,D; E,F) and return elements are distributed symmetrically of a longitudinal median axis of the boot.

10. A boot according to claim 6, wherein:

the combined total of anchoring locations (A,B; C,D; E,F) and return elements is eight; and said anchoring locations (A,B; C,D; E,F) and return elements are distributed symmetrically of a longitudinal median axis of the boot.

11. A boot according to claim 7, wherein:

the combined total of anchoring locations (A,B; C,D; E,F) and return elements is eight; and said anchoring locations (A,B; C,D; E,F) and return elements are distributed symmetrically of a longitudinal median axis of the boot.

12. A boot according to claim 8, wherein:

the combined total of anchoring locations (A,B; C,D; E,F) and return elements is eight; and said anchoring locations (A,B; C,D; E,F) and return elements are distributed symmetrically of a longitudinal median axis of the boot.

13. A boot according to claim 1, wherein each of said return elements includes:

a flat base for engagement with a surface of one of said first and second portions of said upper;

a hole through a first end of said flat base for affixing each said return element to the boot;

a hook having a projecting portion extending from a second end of said flat base to a free end, said hook having a parallel portion extending generally parallel to said flat base and constituting a housing for receiving said lace or cable, said free end of said hook projecting from said portion toward said flat base for retention of said lace or cable following elastic deformation of said hook upon receiving said lace or cable within said housing.

14. A boot according to claim 13, wherein:

said projecting portion of said hook constitutes a portion of said housing and comprises a rounded interior cross-section for facilitating passage of said lace or cable within said housing.

15. A boot according to claim 1, wherein:

the boot is a sport boot.

* * * * *